US005203761A

United States Patent [19]

Reichental et al.

[11] Patent Number: 5,203,761

[45] Date of Patent: Apr. 20, 1993

[54] APPARATUS FOR FABRICATING DUNNAGE MATERIAL FROM CONTINUOUS WEB MATERIAL

[75] Inventors: A. N. Reichental, Southbury; Alexander Shafir, Watertown, both of Conn.

[73] Assignee: Sealed Air Corporation, Saddle Brook, N.J.

[21] Appl. No.: 716,634

[22] Filed: Jun. 17, 1991

[51] Int. Cl.[5] ..... B31F 1/07; B31F 1/26; B31F 5/02

[52] U.S. Cl. ..... 493/346; 493/352; 493/967

[58] Field of Search ..... 493/346, 350, 351, 352, 493/357, 370, 967

[56] References Cited

U.S. PATENT DOCUMENTS

| | | | |
|---|---|---|---|
| 1,975,219 | 10/1934 | Alexander et al. | 164/70 |
| 2,106,246 | 1/1938 | Fourness | 154/54 |
| 2,248,115 | 7/1941 | Olsen | 83/215 |
| 2,502,112 | 3/1950 | Walker | 154/33.05 |
| 2,896,692 | 7/1959 | Villoresi | 154/33.05 |
| 3,205,743 | 9/1965 | Langenberg et al. | 83/215 |
| 3,757,618 | 9/1973 | Kuts | 83/471.3 |
| 3,799,850 | 12/1973 | Gerard | 156/199 |
| 4,014,535 | 3/1977 | Kleid et al. | 493/370 |
| 4,088,049 | 5/1978 | Benedict | 83/240 |
| 4,364,291 | 12/1982 | Jenkner | 83/100 |
| 4,499,040 | 2/1985 | Maemoto et al. | 264/167 |
| 4,557,716 | 12/1985 | Ottaviano | 493/967 |
| 4,593,883 | 6/1986 | Nelson | 254/7 B |
| 4,642,087 | 2/1987 | Hoffman | 493/463 |
| 4,650,456 | 3/1987 | Armington | 493/967 |
| 4,691,605 | 9/1987 | Vanetik et al. | 83/175 |
| 4,699,609 | 10/1987 | Komaransky et al. | 493/357 |
| 4,718,813 | 1/1988 | Kehlenbach | 414/684 |
| 4,884,999 | 12/1989 | Baldacci | 493/967 |
| 5,031,498 | 7/1991 | Koppel | 83/614 |

*Primary Examiner*—William E. Terrell

*Attorney, Agent, or Firm*—Bell, Seltzer, Park & Gibson

[57] ABSTRACT

Apparatus for fabricating discrete segments of cushioned web material for use as dunnage. The apparatus includes a mobile supply cart having at least one substantially horizontal support arm for receiving the hollow core of rolled web material. The apparatus also includes a separate driven rugation device with feed rollers for directing multiple plies of the web material in overlying, contacting relationship along a single path of travel. The separate cart and rugation device may be removably interconnected for lateral alignment. Driven interdigitized texturing rolls downstream of the feed rollers emboss a raised pattern on the web material, and a plurality of separating rollers downstream from the texturing rolls separate the plies of web material and direct them in divergent paths of travel. Combining rolls recombine the plies of textured web material such that the embossed areas of each ply do not directly overlie each other but are offset, creating void areas between the adjacent plies. A driven cutter downstream of the combining rolls severs the recombined offset embossed plies into discrete segments. The cutter may have a rotating disc blade with a peripheral edge which moves transverse to the longitudinal length of the plies to cut the plies. Last, driven exit rollers convey the cut segments of material from the rugation device.

28 Claims, 5 Drawing Sheets

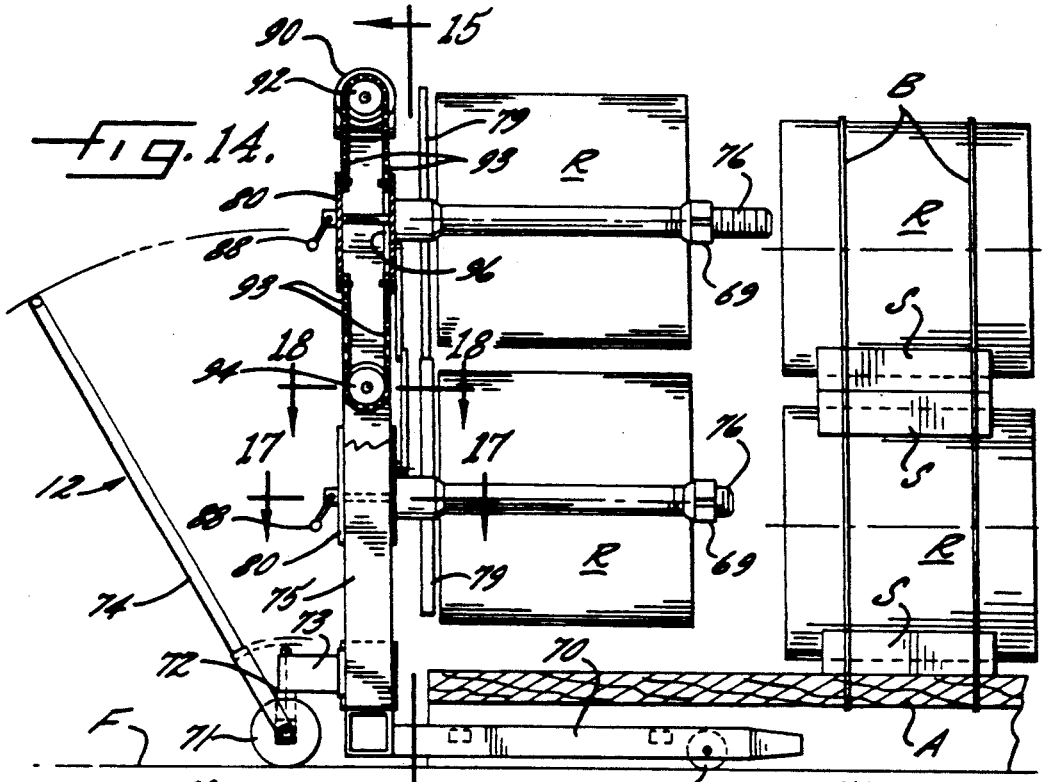
Fig. 14.
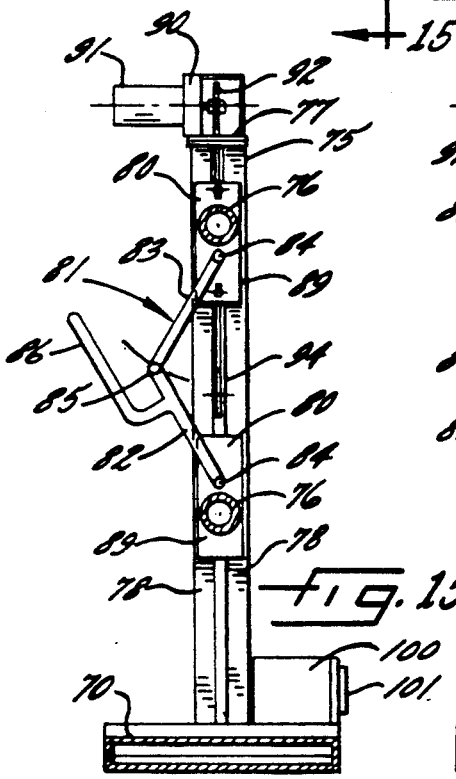
Fig. 15.
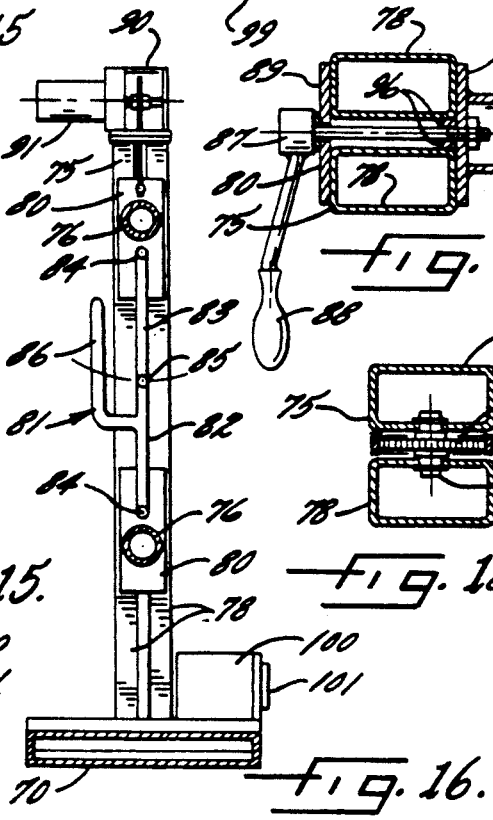
Fig. 16.
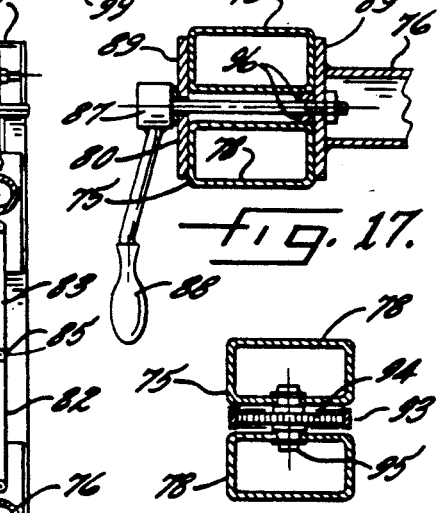
Fig. 17.
Fig. 18.

APPARATUS FOR FABRICATING DUNNAGE MATERIAL FROM CONTINUOUS WEB MATERIAL

FIELD OF THE INVENTION

The present invention relates to apparatus for fabricating cushioned dunnage material for use in packaging or the like. In particular, the invention is directed to apparatus for fabricating cushioned dunnage material from continuous rolls of web material and severing the dunnage material into discrete segments of an appropriate size.

BACKGROUND OF THE INVENTION

Protective packaging for various articles of different sizes and shapes is commonly used in the packaging industry. Often, such protective packaging, or dunnage, is needed for cushioning in shipping containers or the like to protect articles.

In the past, various materials have been used as protective wrapping including dunnage made of embossed web material. Such embossed web material is often chosen due to its relative low cost and disposable nature. Embossed dunnage material has been made from multiple plies of web material such as paper or the like which has been embossed with a raised pattern under high heat and pressure. Typically the pressure used is about 1500 psi, using texturing rolls having mating male and female surfaces which force the paper to deform as it passes through the nip of the rolls. The embossing is often done while the webs are not fully dry so that the paper better retains the embossed pattern.

After embossing, several plies of the embossed material are combined such that the plies are in overlying relationship, but the plies are shifted slightly so that the patterns on the adjacent plies do not correspondingly overlie each other. Thus, the raised portions of the plies abut each other so that void areas are created between the plies. The presence of these void areas gives a cushioned effect to the material.

The embossed material is typically rolled up for bulk transport and storage at a site where the dunnage material is needed for use in packaging or the like. When the dunnage material is to be used, the roll of embossed material is moved to a desired site, and the roll is unwound so that desired lengths of the material may be cut off and used as cushioning material.

Several drawbacks accompany the practices described above. The void areas between the plies of embossed material cause the embossed web material to be substantially bulkier than unembossed plies. Thus, a significantly smaller amount of the embossed material may be stored on a single roll than could be stored on a roll if the paper were not embossed. As a result, more space is required to store and transport a desired quantity of the dunnage material. For example, a single roll of unembossed web material may contain ten times the amount of paper as is contained on a roll of equivalent size having cushioned embossed material with void spaces. Additionally, because less material is retained on the rolls, the embossed dunnage material is depleted relatively quickly when the material is unwound from the rolls and used, thereby requiring frequent resupply of fresh rolls of dunnage material. Of course, the expense to purchase the embossed material is generally greater than the cost of unembossed paper, and the added bulk of the embossed paper increases the cost to transport, store and use the material. It is therefore apparent that the need exists for an improved means for providing cushioned dunnage material to a site for use in packaging operations.

It is an object of the present invention to provide an apparatus for fabricating cushioned dunnage material from multiple plies of continuous web material which avoids the heretofore necessary step of transporting and storing the bulky embossed material prior to use.

Another object of this invention is to provide an apparatus for embossing web materials without the application of heat or pressure.

A further object of the present invention is to provide an apparatus for providing the cushioned web material in discrete segments having a desired length.

A still further object of this invention is to provide an apparatus for providing cushioned dunnage material to a site for use in packaging operations.

Yet another object of this invention is to provide a compact dunnage dispensing apparatus which may be conveniently used at a packaging site.

Another object of this invention is to provide an apparatus which uses identical rolls to emboss a raised pattern on the web material, thus minimizing the expense associated with the rolls.

Still another object of this invention is to provide a new apparatus for transporting and storing web material on rolls.

A further object of this invention is to provide an apparatus for precisely severing the web material into discrete segments having desired lengths.

Another object of this invention is to provide a dunnage fabricating and dispensing apparatus which is less expensive to use than other known devices.

SUMMARY OF THE INVENTION

In accordance with the present invention, these and other objects, features and advantages are achieved in the embodiments illustrated herein by the provision of apparatus for fabricating discrete segments of joined multiple ply cushioned web material for use as dunnage. The apparatus includes a separable mobile supply cart having at least one substantially horizontal cantilevered support arm for receiving a hollow core around which continuous untextured web material is rolled and a driven rugation device with feed rollers for directing multiple plies of the untextured web material from the cart and directing the plies in overlying, contacting relationship along a single path of travel. The separate cart and the rugation device may be removably interconnected so that the untextured web material supplied to the feed rollers is laterally aligned with the feed rollers. Driven interdigitized texturing rolls located downstream of the feed rollers emboss a raised pattern on the web material, which passes through the nip of the rolls. A plurality of separating rollers downstream from the texturing rolls separate the overlying textured plies of web material and direct each ply in divergent paths of travel. Driven combining rolls recombine the plies of textured web material such that the embossed areas of each ply do not directly overlie each other but are offset, creating void areas between the adjacent plies. A driven cutter downstream of the combining rolls severs the recombined offset embossed plies into discrete segments. In one aspect of this invention, the cutter may have a driven rotating disc blade with a peripheral edge which moves transverse to the longitudinal length of the plies to cut the plies. Last, driven exit rollers convey the out segments of material from the rugation device.

BRIEF DESCRIPTION OF THE DRAWINGS

Other objects, features and advantages of the invention will be apparent from the detailed description of the invention when taken in conjunction with the accompanying drawings, in which:

FIG. 14 is a side elevation view of a mobile roll supply cart made in accordance with the present invention and a pallet carrying rolls of web material;

FIG. 15 is a partially sectional front elevation view taken along line 15—15 of FIG. 14 and which illustrates the arm adjustment linkage in an extended position;

FIG. 16 is another view of the supply cart shown in FIG. 15 which illustrates the arm adjustment linkage in a linear position;

FIG. 17 is a section view taken along line 17—17 of FIG. 14; and

FIG. 18 is a section view taken along line 18—18 of FIG. 14.

DESCRIPTION OF THE PREFERRED EMBODIMENTS

Figure 1:
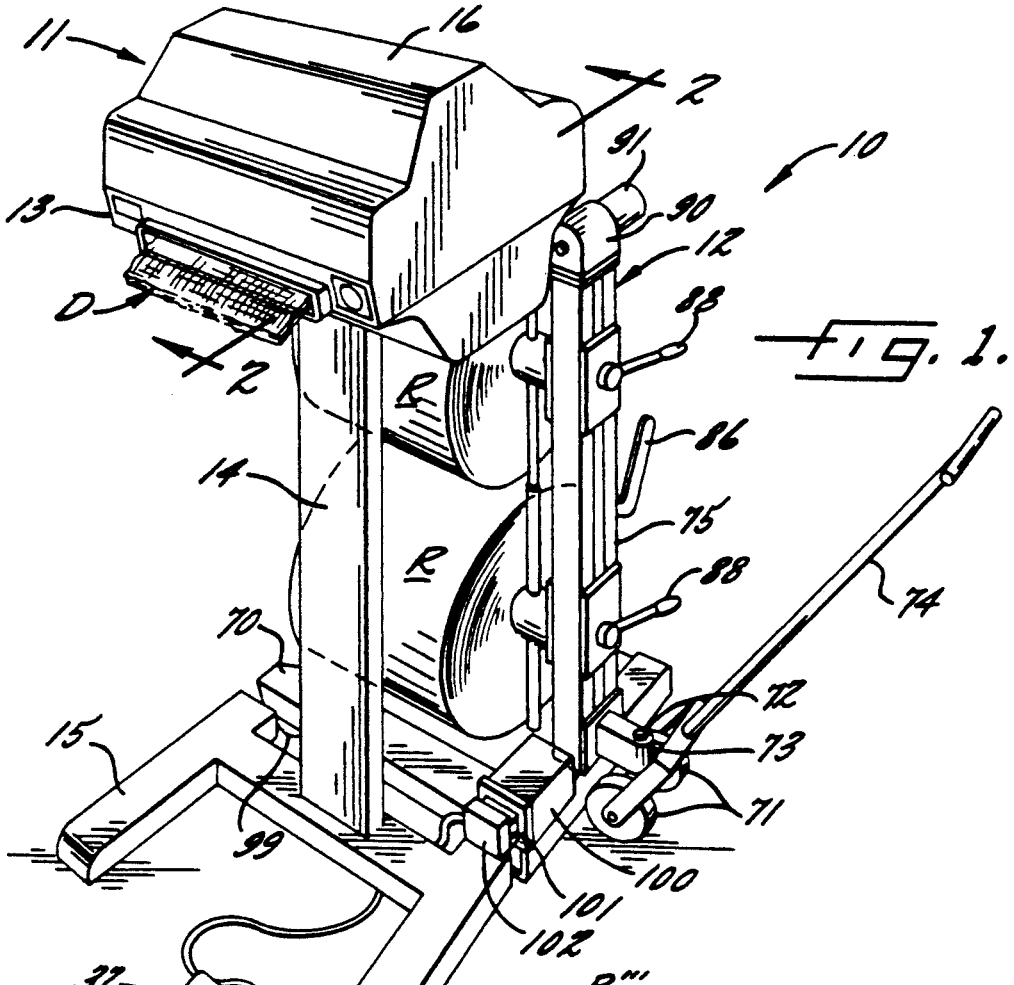
FIG. 1 is a perspective view of a mobile roll supply cart and a separate rugation device made in accordance with the invention.

Referring now more specifically to the drawings, FIG. 1 shows a perspective view of a preferred embodiment of the apparatus indicated generally at 10. The apparatus 10 includes a separate rugation device 11 and a mobile roll supply cart 12. As shown in FIG. 1, the supply cart 12 supports one or more rolls R of unembossed web material such as paper or the like in close proximity to the rugation device 11. The untextured web material is unwound from the rolls R is and supplied to the rugation device 11 for fabrication into a joined multiple ply cushioned web material D for use as dunnage in packaging or the like. In a preferred embodiment, the web material may be supplied as multiple plies wound onto a single roll R.

The operative portions of the rugation device 11 are retained within a housing 13 which is supported by a frame 14. In a preferred embodiment, the frame 14 extends upwardly to support the bottom of the housing 13 and the operative components of the rugation device 11. The frame 14 may also include a wide base 15 for increased stability. The housing 13 includes an upper cover 16 which may be removed to gain access to the operative elements of the rugation device 11.

Figure 2:
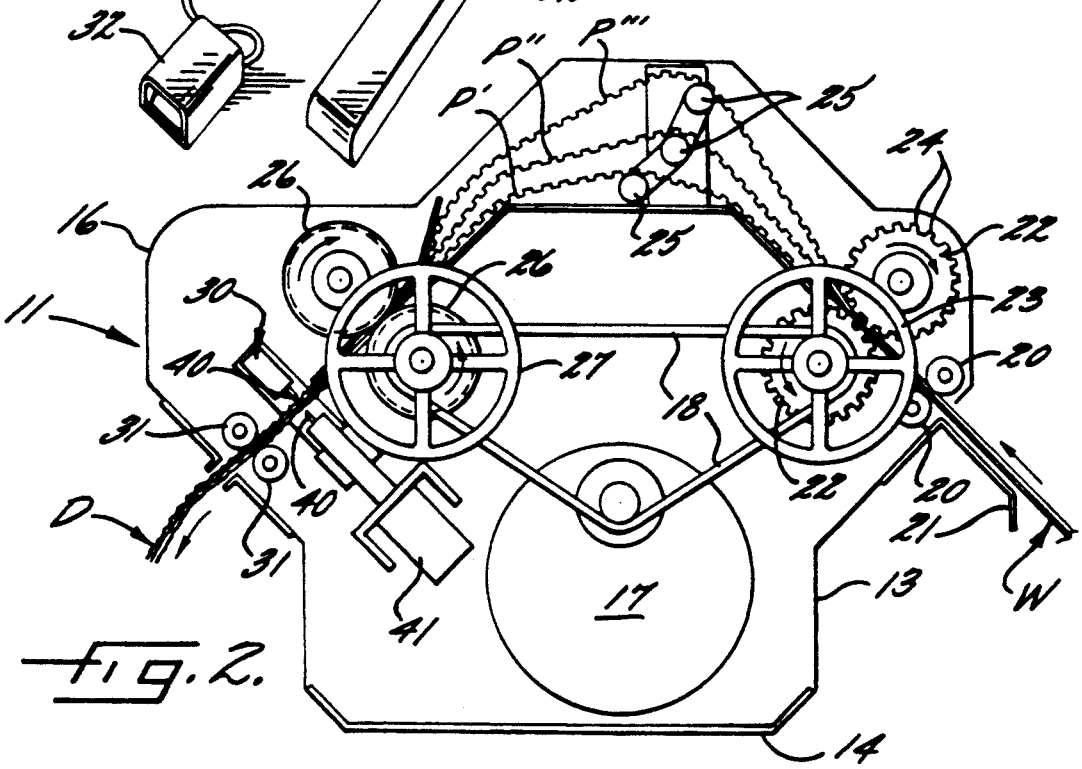
FIG. 2 is a schematic sectional view taken along line 2—2 of FIG. 1 which illustrates the features of the rugation device and the web material passing along the path of travel in the rugation device.

As shown schematically in FIG. 2, the web material W enters the rear portion of the rugation device 11 and moves through the rugation device 11 in a predetermined path of travel. A drive means 17 is mounted on the frame 14 within the housing 13 to provide motive power to the operative components of the rugation device 11. In a preferred embodiment, the drive means 17 is an electric motor which is connected to the operative components by a belt drive system 18.

A plurality of feed rollers 20 are provided within the housing 13 above the frame 14. The multiple plies of untextured web material W which pass between the feed rollers rollers 20 are supplied from a continuous source, namely, the rolls R on the cart 12. The feed rollers 20 may be driven by the drive means 17 via a drive belt or the like. The feed rollers 20 direct the multiple plies in overlying, contacting relationship along a single predetermined path of travel through the rugation device 11. As shown in FIG. 2, an ancillary guide such as a plate 21 or the like may extend from the housing 13 to assist in orienting the web material W.

A pair of interdigitized texturing rolls 22 are located downstream of the feed rollers 20 on the frame 14 of the rugation device 11. The texturing rolls 22 are driven by the drive means 17 to further advance the web material W along the path of travel through the rugation device 11. One of the texturing rolls 22 is disposed above the path of travel of the web material W, whereas the other texturing roll 22 is disposed beneath the path of travel. The rolls 22 are driven by the belt drive system 18 and are also provided with a hand wheel 23 which may be used to introduce the web material W into the rugation device 11 and to manually advance the web material W through the rugation device 11.

Figure 3:
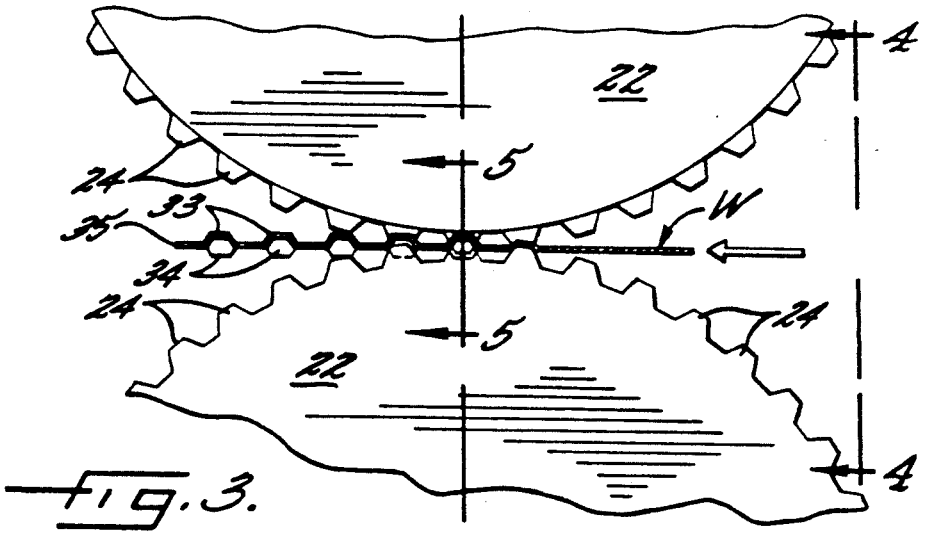
FIG. 3 is an enlarged partial elevation view taken in the direction of the axis of the texturing rolls illustrating the nip of the texturing rolls and the web material passing through the nip.
Figure 4:
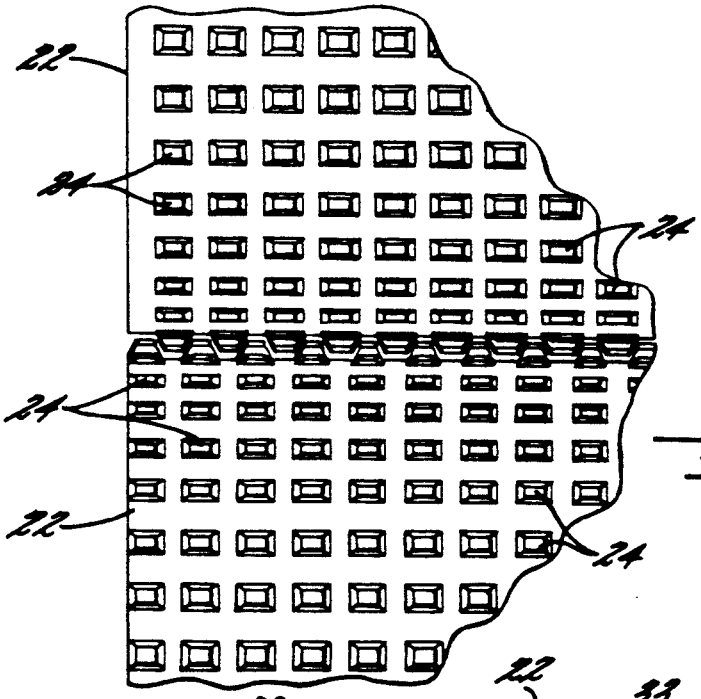
FIG. 4 is a partial rear elevation view taken along line 4—4 of FIG. 3.
Figure 5:
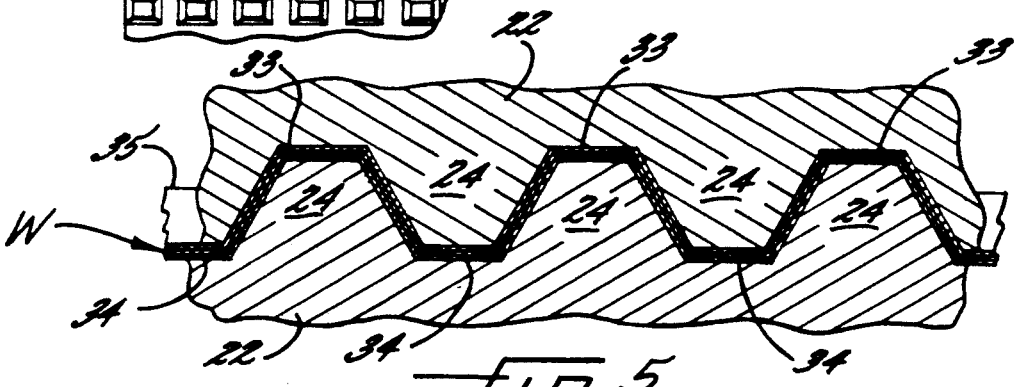
FIG. 5 is an enlarged, partial sectional view taken along line 5—5 of FIG. 3 illustrating the intermeshing teeth of the texturing rolls and the web material being embossed thereby.

The texturing rolls 22 are positioned closely adjacent each other to form a nip at their closest point of contact. As explained hereinbelow, and as shown in FIGS. 3 through 5, the texturing rolls 22 have a plurality of discontinuous teeth 24 projecting from their surfaces such that when the overlying, contacting plies of web material W move through the nip between the rolls 22, a raised pattern is embossed on the web material W.

A plurality of separating rollers 25 are located within the housing 13 downstream from the texturing rolls 22. The separating rollers 25 are spaced apart from each other slightly so as separate the individual plies P', P'' and P''' of the web material W and to individually direct each ply P in a divergent path of travel. The separating rollers 25 may be pivotally mounted from the frame 14 by arms or the like, which may be spring loaded so as to maintain tension in the separated plies P and to take up any slack that may appear in the plies P. In a preferred embodiment, there are three separating rollers 25. It is to be understood that the number of plies P may vary and that the number of separating rollers 25 may also vary so that there is one roller 25 for each ply P.

A pair of driven combining rolls 26 are rotatably mounted on the frame 14 downstream of the separating rollers 25. The combining rolls 26 recombine the separated plies P of embossed web material W into overlying, contacting relationship. The combining rolls 26 are also driven by the drive means 17 via the drive belt 18. A hand wheel 27 is also provided on at least one of the combining rolls 26 to aid in manually advancing the web material W through the rugation device 11.

The combining rolls 26 have a surface designed to avoid crushing or compacting the embossed raised pattern on the plies P. In a preferred embodiment, the combining rolls 26 have a plurality of thin bands around their periphery which have a relatively larger diameter than the remaining portions of the combining roll 26. Thus, the combining rolls 26 contact each other along the bands, thus joining the plies P along those bands, but otherwise avoiding damage to the embossed pattern on the plies P.

Figure 8:
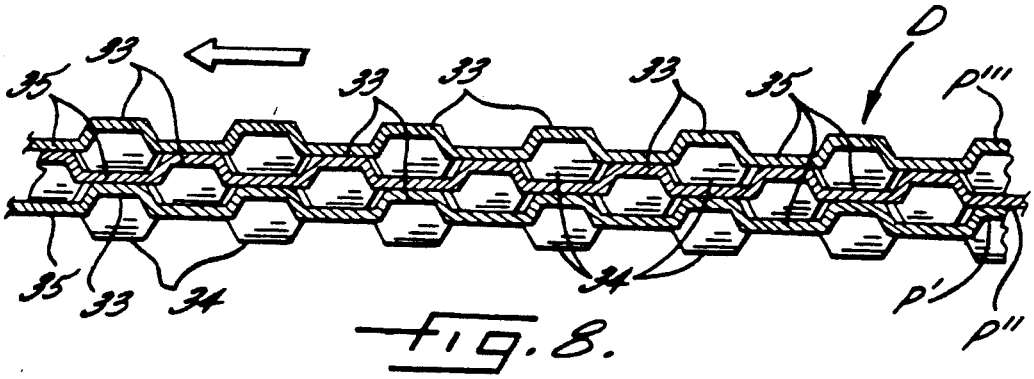
FIG. 8 is a partial section view of the embossed web material and the void areas formed between the plies after they have been separated, routed in divergent paths and recombined.

The combining rolls 26 are positioned such that each of the divergent paths of travel of the separated plies P', P'' and P''' from the texturing rolls 22, over the separating rollers 25 and to the combining rolls 26 has a length different from the length of the path of travel of the ply P adjacent thereto. Thus, when the separated plies P are recombined by the combining rollers 26, the embossed areas on each ply P do not directly overly each other but are offset. Thus, void areas are created between the adjacent plies P, thereby forming a multiple ply cushioned web material, or dunnage D, as shown in FIG. 8.

Referring again to FIG. 2, severing means 30 is located downstream from the combining rolls 26. The severing means 30 may be actuated by an operator or by automatic means to cut the cushioned web material D at desired points. Last, driven exit rollers 31 further convey the material D from the rugation device and deposit the finished material D at a desired location for use in packaging or the like.

In a preferred embodiment, the texturing rolls 22 of the rugation device 11 are identical. Each roll 22 has a plurality of discontinuous protecting teeth 24. As shown in FIGS. 3, 4 and 5, the teeth 24 are positioned and shaped so as to intermesh with the teeth 24 projecting from the opposing roll 22. In a preferred embodiment, the teeth 24 intermesh with each other laterally, as shown in FIG. 4, to emboss the web material W with a raised pattern undulating from side to side, as shown in the cross section of FIG. 5.

It is preferred that the adjacent teeth 24 on roll 22 are laterally separated by bottom lands of between about 0.06 and 0.11 inches wide and that the teeth 24 are circumferentially separated by bottom lands between about 0.08 and 0.13 inches wide. In one embodiment, the teeth 24 are separated laterally by bottom lands about 0.0804 inch wide and are circumferentially separated by bottom lands about 0.1099 inch wide. Also, it is preferred that the top land on each tooth 24 be between about 0.04 and 0.07 inches wide in the circumferential direction of the roll 22. In a particularly preferred embodiment, the top land on each tooth 24 is about 0.0586 inch in the circumferential direction of the roll 22.

In the preferred embodiments, the sides of each tooth 24 are inclined slightly so that each tooth 24 has a truncated pyramidal shape. The side of each tooth 24 which is parallel to the axis of the roll 22 may be inclined at an angle of between about 55° and 70° relative to the side of an adjacent tooth 24, and preferably, at about 63°. The lateral sides of the teeth 24 may be inclined at an angle of between about 45° and 65° relative to the lateral side of each adjacent tooth 24, and preferably, at about 55°.

Preferably, the teeth 24 project between about 0.07 and 0.12 inches above the surface of the rolls 22. In one embodiment, the teeth 24 project about 0.0910 inch above the surface of the rolls 22. The centers of the teeth 24 may also be laterally separated by between about 0.15 and 0.35 inches, and preferably, by about 0.2409 inch. The adjacent vertical axes of the teeth 24 may extend from the center of the roll 22 at between about 7° and 11° relative to each other, measured circumferentially around the roll 22, and preferably, about 9° relative to each other.

The spacing between the texturing rolls 22 is also adjustable so that the rugation device 11 may be used to emboss a variety of web materials W varying in thickness or number of plies. One or more of the texturing rolls 22 may be supported by bearings mounted on slidable supports, so that the spacing between the rolls 22 may be automatically adjusted by spring pressure or the like. Alternatively, manual means may be used to adjust the nip of the rolls 22. In one preferred embodiment in which the rolls 22 are used to emboss three plies of web material W, the space between the adjacent lands of the opposed rolls 22 is about 0.012 inch.

It is to be understood that the foregoing dimensions and parameters of the rolls 22 and teeth 24 may be varied to accommodate variations in the thickness of the material to be embossed, the number of plies to be embossed, the type of pattern sought to be embossed or other readily apparent factors associated with operation of the rugation device 11.

The rugation device 11 may also include control means by which an operator may manually actuate the drive means 17 and the severing means 30 so that the embossed web material may be cut into discrete segments having desired lengths. In a preferred embodiment, the control means may be an electrical foot switch 32 which is connected to the electrical power source of the electrical motor drive means 17 and the severing means 30.

When a segment of dunnage material D is desired, an operator may depress the foot switch 32, thereby energizing the drive means 17. This advances the web material W through the rugation device, causing the finished material D to be ejected from the exit rollers 31 at the front of the rugation device 11. When the operator determines that a sufficient amount of material D has been produced, the foot switch 32 may be released. This interrupts the power flow to the drive means 17, thereby halting the advance of the web material W through the rugation device 11. When the advance of the material W through the device 11 has stopped, the severing means 30 is actuated to cut the cushioned web material D into a discrete segment having the length desired by the operator. After cutting, the driven exit rollers 31 may also further convey the remaining portions of the cut segment of material D away from the rugation device 11.

In an alternative embodiment, automatic means may be used to actuate the drive means to advance and emboss the web material intermittently and to actuate the severing means 30 to cut the material into discrete segments having a preset length. For example, a predetermined length may be input into an electronic means which automatically measures the length of material D being emitted from the exit rollers 31 so that the severing means 30 may cut the material at an appropriate point. In this embodiment, the automatic means may be actuated by the foot switch 32.

Figure 6:
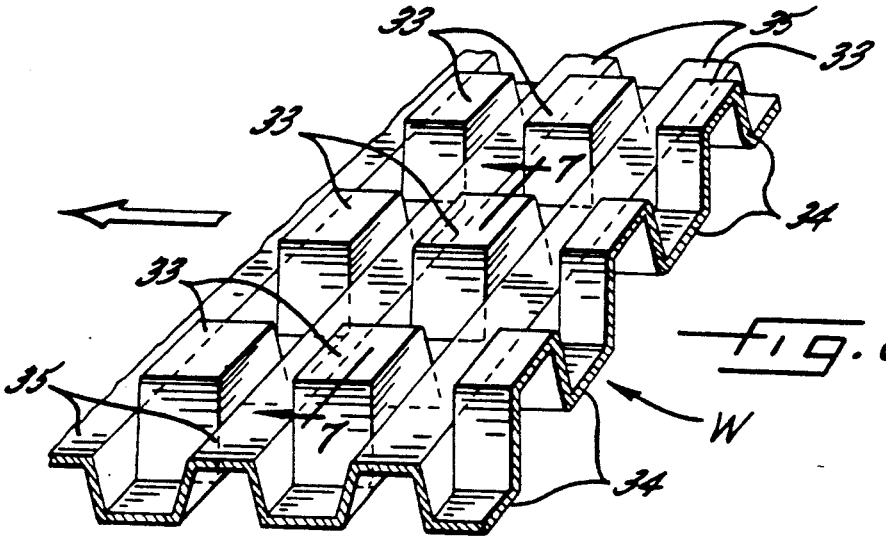
FIG. 6 is a perspective view of the overlying, embossed plies of web material after they have passed through the texturing rolls.
Figure 7:
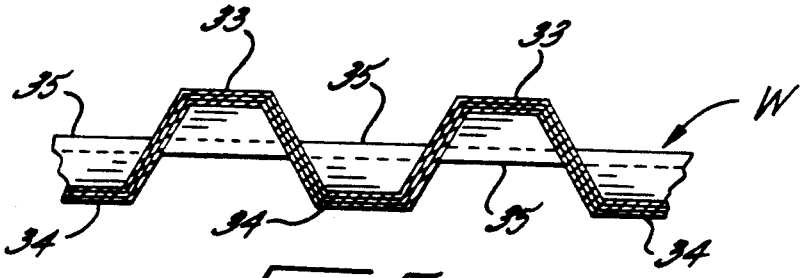
FIG. 7 is a partial section view taken along line 7—7 of FIG. 6.

The embossed web material W produced by the texturing rolls 22 is illustrated in FIGS. 6 and 7. The arrow in FIG. 6 corresponds to the direction of travel of the web material W through the texturing rolls 22. Elevated portions 33 result from the discontinuous teeth 24 which project from the bottom texturing roll 22 in the rugation device 11, whereas depressed portions 34 are formed by the teeth 24 which project downwardly from the upper roll 22.

As shown in FIG. 4, the teeth 24 are separated laterally and around the circumference of the rolls 22 by spaces, or bottom lands. Because the teeth intermesh laterally, as shown in FIGS. 4 and 5, the elevated and depressed portions 33 and 34 are not formed along unembossed strips 35 in the resultant embossed web material W. These unembossed strips 35 extend transversely across the resultant embossed material, as shown in FIGS. 6 and 7. FIG. 7 further illustrates the positioning of the elevated and depressed portions 33 and 34 relative to the unembossed strips 35.

After the plies P of the web material W are separated, routed across the separating rollers 25 and collected by the combining rollers 26, the resultant cushioned dunnage material D is formed. A cross section view of this finished material is shown in FIG. 8. As shown therein, the plies P', P'' and P''' do not overlie each other exactly as they had before being separated, as was shown in FIG. 7. Instead, the elevated portions 33 and depressed portions 34 are shifted and abut against each other or the unembossed strips 35. The arrow in FIG. 8 shows the orientation of the finished embossed material D relative to the path of travel through the rugation device 11, similar to the arrow in FIG. 6. As can be readily seen, the resultant cushioned multiple ply material D has significantly greater bulk than the unembossed web material W or the embossed material W had prior to separation, staggering and recombining, as shown in FIG. 7.

In an alternative embodiment, the rugation device 11 may also include means for folding over the embossed plies P after they have passed through the separating rollers 25 to their being recombined by the combining rolls 26. The folding means folds the plies over widthwise, thereby forming a dunnage material having approximately twice the thickness but hal the width of the unfolded material D.

In a preferred embodiment, the rugation device 11 is sufficiently versatile to permit use of varying numbers of plies of web material W and different compositions of material W. One preferred embodiment of the invention is capable of fabricating and providing dunnage material D to a packaging line which requires sufficient material for packaging between about 500 and 1,400 units per day.

To begin use of the rugation device 11, an operator manually feeds multiple plies of unembossed web material W from the rolls R into the feed rolls 20 and manually advances the web material W through the nip of the texturing rolls 22 by turning the hand wheel 23. The operator then continues to advance the web material W through the device 11 by continued turning of the hand wheel 23. The individual plies P of the web material W are then manually separated and are individually routed over each separating roller 25. Plies P are then routed through the combining rolls 26 and the operator advances the plies P through the rolls 26 by turning the hand wheel 27. Continued turning of the hand wheels 23 and 27 advances the web material through the severing means 30 and the exit rollers 31 and out of the rugation device 11. The feed rollers 20 and exit rollers 31 may also be connected to the hand wheels 23 and 27 to aid in advancing the web material W through the rugation device 11.

In a preferred embodiment, a safety switch is provided so that the drive means 17 of the rugation device 11 will not function if the cover 16 is not in place. Thus, when the cover 16 is replaced the web material W may thereafter be advanced through the device 11 by the drive means 17.

As shown in FIG. 2, the severing means 30 may be a driven knife having opposed blades 40. A solenoid 41 or other drive means may be used to advance one of the blades 40 through the cushioned web material D passing between the two blades 40 to sever the cushioned material D.

In an alternative embodiment, the rotary disk cutter illustrated in FIGS. 9 through 13 may be used as the severing means 30 in the rugation device 11. A support for the cushioned material D is provided in the region of the severing means 30. In a preferred embodiment, the support may be a table 42 which is provided beneath the path of travel of the cushioned web material D in the rugation device 11 between the exit rollers 31 and the combining rolls 26. A track 43 is positioned substantially parallel to the table 42 and is separated from the table 42 by a space sufficient to permit passage of the cushioned web material D between the table 42 and the track 43. The track 43 is aligned generally transverse to the direction of travel of the material D through the rugation device 11. A slot 44 may be formed in the table 42 parallel and in close proximity with the track 43.

As illustrated in FIGS. 9 through 13, a carriage 50 is suspended on the track 43. The carriage 50 is mounted on the track 43 so as to permit easy translational movement of the carriage 50 along the track 43. Thus, the carriage 50 may move from side to side of the path of travel. The carriage 50 has a drive means mounted thereon. In a preferred embodiment, the drive means is a reversible electric motor 51. The carriage 50 also carries a track engagement means driven by the electric motor 51 for propelling the carriage 50 along the track 43 in translational motion. In a preferred embodiment, the track engagement means is at least one drive wheel 52 driven by the drive means 51. A plurality of non-driven wheels 54 may also be provided beneath the track 43 to stabilize the carriage 50 as it moves along the track 43. Side Wheels 57 may also be carried on the carriage 50 on each side of the track 43.

The cushioned material D is cut by a driven rotating disk blade 55 which has a sharpened peripheral edge 56. The blade 55 is suspended from the carriage 50 such that a portion of the blade 55 extends through the material D. The blade 55 may also extend into the slot 44. Alternatively, other means may be provided for receiving a portion of the blade 55. The rotating disk blade 55 is driven by the drive means such as the electric motor 51 located on the carriage 50.

Also in the preferred embodiment, a belt 60 transmits power from the electric motor 51 to the track engagement wheel 52 and the rotary disk blade 55 via pulleys 61, 62 and 63 which are respectively connected to those components. Tension in the belt 60 may be maintained by an idler 64.

In a preferred embodiment, the carriage 50 may operate in a reversible fashion on the track 43. This may be accomplished by use of a reversible motor 51 or other drive means so that the track engagement wheel 52 will urge the carriage 50 along the track 43 in either direction.

The electric motor 51 or other drive means may be actuated to urge the carriage 50 in a first direction from a first end of the track 43 to a second end thereof. As the carriage 50 moves along the track 43, the blade 55 likewise rotates to cut the web material W as it passes across the web material. When the carriage 50 has traversed the width of the web material, the electric motor 51 is stopped and the carriage 50 comes to rest. Also, the rotary blade 55 stops turning. When another cut is to be made, however, the electric motor 51 is actuated in the reverse direction, thereby propelling the carriage 50 in a reverse direction from the second end of the track 43 back to the first end. The direction of rotation of the rotary disk blade 55 is likewise reversed. Thus, the portion of the peripheral edge of the blade 55 which faces in the direction of motion of the carriage 50 always rotates toward the table 42 as the carriage 50 moves so as to sever the cushioned material D from the top side thereof when the carriage 50 is moved along the track 43.

Figure 9:
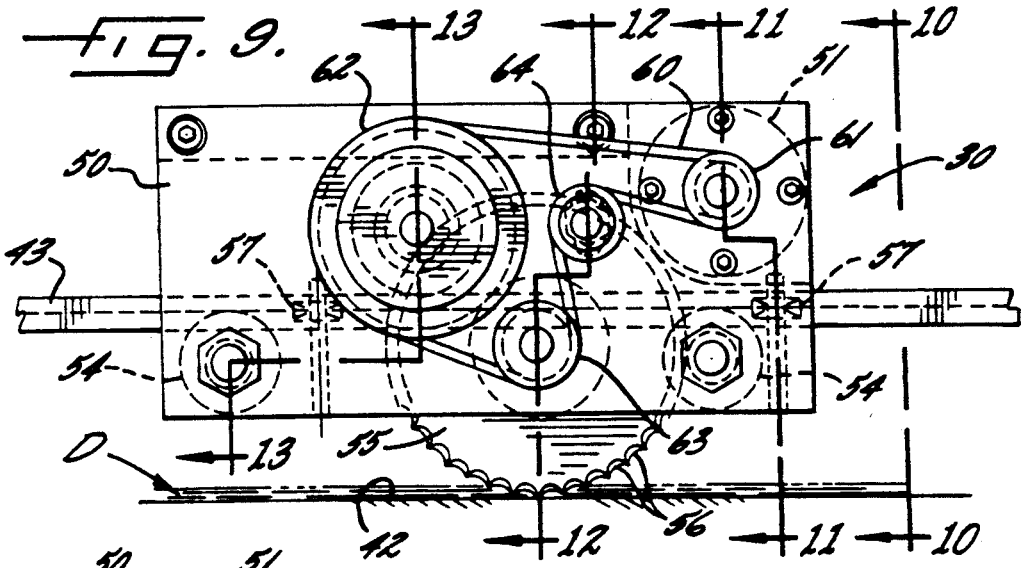
FIG. 9 is an elevation view of a rotary disk cutter made in accordance with the present invention.
Figure 10:
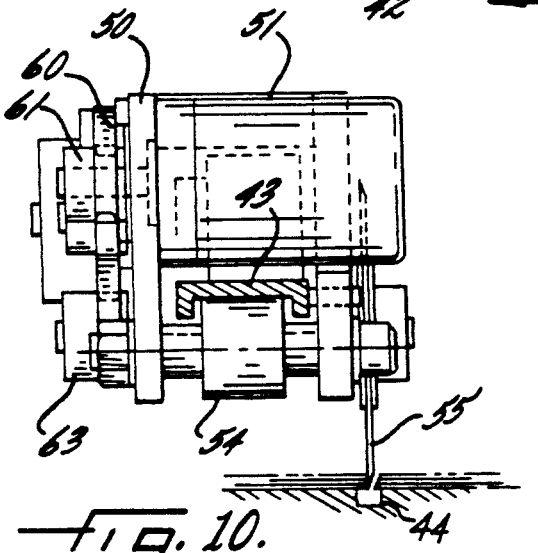
FIG. 10 is a partially sectional elevation view taken along line 10—10 of FIG. 9.
Figure 11:
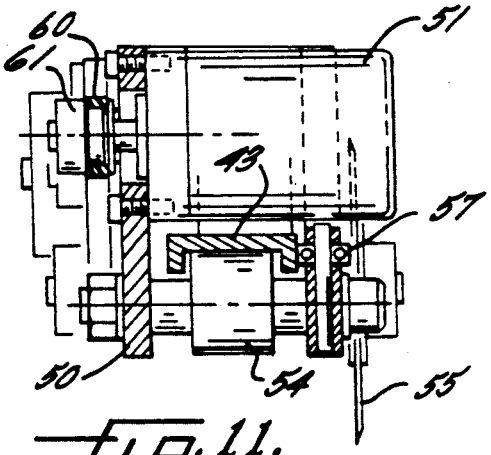
FIG. 11 is a section view taken along line 11—11 of FIG. 9.
Figure 12:
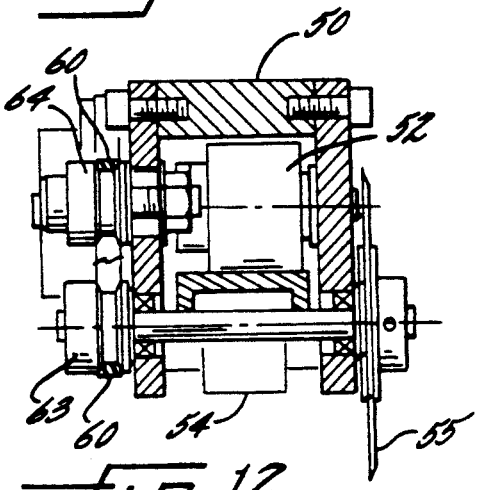
FIG. 12 is a section view taken along line 12—12 of FIG. 9.
Figure 13:
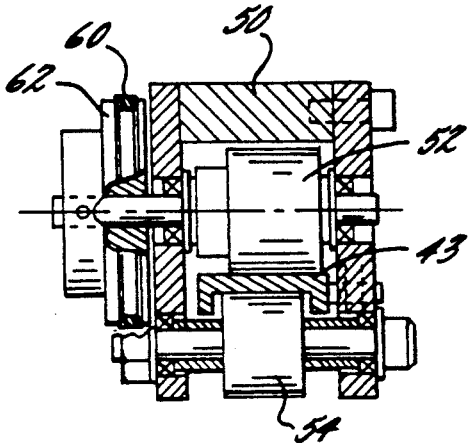
FIG. 13 is a section view taken along line 13—13 of FIG. 9.

In a preferred embodiment, the blade 55 has a serrated edge 56, as best shown in FIG. 9. A regular circular edge may also be used. The blade 55 may rotate at a speed of between about 2,000 and 6,000 rpm for cutting, and in a preferred embodiment, the blade 55 rotates at about 4,000 rpm. The rotation speed of the blade 55 may vary over a wide range depending on the type and thickness of material to be cut, the sharpness and shape of the edge 56 of the blade 55 or the like.

As may be readily seen, the rotary disc cutter is not limited to severing embossed web material D but may also be used for precisely severing continuous sheet material of many kinds, such as paper, plastic sheeting or the like.

One preferred embodiment of the mobile roll supply cart 12 is shown in FIGS. 1 and 14 through 18. As shown in FIGS. 1 and 14, the cart may receive, transport and store a continuous sheet material such as paper, plastic or the like that is wound as a roll R on a hollow core.

The cart 12 includes a bottom frame 70 from which a plurality of wheels 71 and 99 are mounted so that the cart 12 may be easily moved by an operator from one location to another on a floor F. The wheels 71 may be pivotable by means of a pivot 72 and bracket 73 which are affixed at one end of the frame 72. A handle 74 may also be affixed to the axle of the pivotable wheels 71 so that an operator may push or pull the cart 12 and may pivot the wheels 71 to guide the cart 12 in a desired direction.

A support pylon 75 extends upwardly from one end of the frame 70. In a preferred embodiment, the pylon 75 extends upwardly from the end of the frame 70 which is nearest the pivotable wheels 71 and handle 74. As shown in FIGS. 17 and 18, the pylon 75 may be formed of two rectangular posts 78 which are connected at their top ends by a plate 77.

At least one substantially horizontal cantilevered arm 76 extends laterally from the pylon 7 for receiving the hollow core of a roll R of sheet material. In the preferred embodiments, a plurality of arms 76 extend from the pylon 75, and in one preferred embodiment, two arms 76 extend from the pylon 75 such that one arm 76 is positioned directly above the lower arm 76. Also in this embodiment, the upper arm 76 is slightly longer than the lower arm 76, for reasons which will be explained hereinbelow.

Means are provided in the pylon 75 for adjusting the height of the cantilevered core receiving arms 76. Each arm 76 is slidably connected to the pylon 75 by cars so which may slide up and down the length of the pylon 75. The cars 80 include locking means 87 which is manually operated by moving the handle 88. When it is desired to lock the cars so along the length of the pylon 75, movement of handle 82 compresses the opposing plates 89 located on each side of the pylon 75 so that they frictionally engage the sides of the pylon 75.

Each core receiving arm is sufficiently long to retain at least one roll R thereon. After a roll R has been placed on the arm 76, a retainer 69 may be placed on the ends of the arms 76 to securely retain the rolls R and prevent them from inadvertently slipping off the arms 76. The rolls R are also maintained a distance away from the operative components of the pylon 75, the cars 80 and the associated components by telescoping retainer rods 79.

The position of the lower car 80 and the associated arm 76 may be adjusted relative to the position to the upper car so and arm 76 by a manually operated articulating adjustment linkage 81. As best shown in FIGS. 16 and 17, the linkage 81 includes a handle link 82 and a connecting link 83. The links 82 and 83 extend longitudinally between pins 84 on the upper and lower cars 80. The links 82 and 83 are joined to each other by a pin 85.

The handle link 82 may include an extended handle 86 which may be grasped by an operator. When the handle 86 is pulled laterally away from the pylon 75, the ends of the linkages 82 and 83 which are pinned to the cars 80 are urged together. When the upper car 80 is locked on the pylon 75 by the locking means 87 and when the locking means 87 on the lower car 80 is released, movement of the adjustment linkage 81 urges the lower car and the associated lower arm 76 upwards, towards the upper arm 76 and car 80.

As shown in FIG. 16, release of the handle 86 and the locking means 71 on the lower car permits the car so to slide downward along the pylon 75, thus straightening the links 82 and 83. Thus, lateral motion of the handle 86 permits adjustment of the lower arm 76 between an upper position relative to the upper arm 76, as shown in FIG. 15, and a lower position relative to the upper arm 76, as shown in the FIG. 16.

The arms 76 may also be moved by automatic lifting means 90. Lifting means 90 includes an electric motor 91 and sprocket 92 mounted atop the plate 77 above the pylon 75. The sprocket 92 drives a chain 93 which has one end pinned to an upper portion of the plates 89 of the upper car 80. A lower sprocket 94 is connected by a pin 95 between the parallel upwardly extending posts 78 of the pylon 75, as best shown in cross section in FIG. 18. The chain 93 also passes around the lower sprocket 94 and has its ends pinned to a lower region of the plates 89 on the upper sliding car 80. The unpinned side of the chain 93 passes between the posts 78. The chain 93 may be joined by thin plates 96 to provide space for sliding around the locking means 87.

In a preferred embodiment, the drive means may be an electric motor 91 which is powered by a portable power supply such as a trickle charged battery 100 or the like. In a preferred embodiment, the battery 100 is located on the frame 70 beside the pylon 75.

As shown in FIG. 14, the cart 12 may be used to lift multiple rolls R of sheet material from a stacked position on a pallet A or the like. To lift the rolls R, an operator pushes the handle 74 to move the cart 12 toward two rolls R stacked on the pallet A. In a preferred embodiment, the rolls R are stacked as shown in the right hand portion of FIG. 14, with stacking cushions S and banding B maintaining the rolls R in a stacked position.

When it is desired to lift the rolls R, an operator pushes the handle 74 to urge the cart 70 toward the stacked rolls R. Because the upper arm 76 is longer than the lower arm 76, the lifting means 90 is actuated to position the upper arm 76 at a proper height so that it may be inserted into the core of the upper roll R. The operator then pushes the cart 12 to advance the upper arm 76 a few inches into the core of the upper roll R. Next, the handle 86 is used to adjust the height of the lower arm 76 so that it may be inserted into the core of the lower stacked roll R. Once both arms 76 have been properly aligned, the operator pushes the cart 12 so that the arms 76 extend completely through the cores of the stacked rolls R. The retainer 78 may then be positioned on the ends of the arms 76 to secure the rolls R between the telescoping retainer rods 79 and the retainer 78.

Once the arms 76 have been inserted into the stacked rolls R, the bands B and the stacking cushions S may be removed from the rolls R and the rolls lifted by lifting means 90. Turning of the motor 91 and the sprocket 92 drives the chain 93, thereby raising the upper car 80 and straightening the linkage 81 to the position shown in FIG. 16. Once the linkage 81 has been straightened, the lower car 80 is also raised by the lifting means 90. Operation of the motor 91 in a reverse direction drives the chain 93 in an opposite direction, thereby lowering the arms 76.

In a preferred embodiment, the cart 12 may be secured by releasable engagement means to the frame 14 of the rugation device 11. The releasable engagement means may be a plurality of hooks extending from the rear portion of the base 15 of the rugation device 11. The hooks fit into a plurality of openings in the frame 70 of the cart 12. When the cart 12 has been moved into close proximity with the rear of the rugation device 11, an operator may position the ends of the hooks through the openings in the frame 70 so as to engage the cart 12. Cooperation of the hooks and openings therefore ensure that the cart 12 is aligned with the rugation device 11 so that the plies of web material W that are supplied to the feed rollers 20 from the rolls R are laterally aligned with the feed rollers 20.

Also in the preferred embodiment, the electric battery 100 is of a rechargeable type. Thus, when the cart 12 releasibly engages the frame 14, the battery 96 may also releasibly engage a recharging source by means of releasable contacts 101 and 102. The contacts 102 on the frame 14 are connected to a source of electrical power to recharge the battery 100.

The invention has been described in detail with particular reference to preferred embodiments and the operation thereof, but it is understood that variations, modifications, and the substitution of equivalent means can be effected within the spirit of this invention.

What is claimed is:

1. An apparatus for fabricating discrete segments of joined multiple ply cushioned web material in desired lengths for use as dunnage in packaging or the like, comprising:

a mobile supply cart for retrieving, transporting and storing web material rolled onto a hollow core, said cart having at least one cantilevered support arm extending in a substantially horizontal orientation for receiving a hollow roll core;

a rugation device comprising;

drive means;

a plurality of feed rollers on said rugation device for collecting multiple plies of untextured web material from the roll on said mobile supply cart and for directing the collected web material in overlying, contacting relationship along a single predetermined path of travel through said rugation device;

a pair of driven interdigitized texturing rolls downstream of said feed rollers, one said texturing roll disposed on each side of said single path of travel for embossing a raised pattern on the overlying, contacting plies of web material and for advancing the web material along said path of travel;

a plurality of separating rollers downstream from said texturing rolls for separating the overlying textured plies of web material and directing each ply in divergent paths of travel;

driven combining rolls downstream of said separating rollers for recombining the separated plies of textured web material into overlying, contacting relationship, said combining rolls being positioned such that each said path of travel of each separated ply of embossed web material from said texturing rolls, over said separating rollers and to said combining rolls has a length different from the length of the path of travel of the ply adjacent thereto, whereby when the plies are recombined the embossed areas of each ply do not directly overlie each other but are offset, creating void areas between the adjacent plies to form a multiple ply cushioned web material;

a driven cutter located downstream of said combining rolls for precisely and cleanly severing the recombined offset embossed plies into discrete segments, said cutter having a rotating disc blade with a peripheral edge which moves transverse to the longitudinal length of the plies; and driven exit rollers for conveying the cut segments of cushioned web material from said rugation device; and means for interconnecting said rugation device and said mobile supply cart such that the plies of untextured web material supplied by said cart to said feed rollers are laterally aligned with said feed rollers.

2. The apparatus defined in claim 1 further comprising control means by which an operator may actuate said drive means and said cutter for intermittently advancing and embossing the web material and severing the material into discrete segments having desired lengths.

3. The apparatus defined in claim 2 wherein said control means is a foot switch.

4. The apparatus defined in claim 1 further comprising automatic means for actuating said drive means and said cutter for intermittently advancing and embossing the web material and for severing the embossed web material into discrete segments having preset lengths.

5. The apparatus defined in claim 1 wherein each said texturing roll has discontinuous projecting teeth which intermesh with said teeth on said opposed texturing roll.

6. The apparatus defined in claim 5 wherein said texturing rolls are identical.

7. The apparatus defined in claim 6 wherein said teeth project about 0.0910 inch from said texturing rolls.

8. The apparatus defined in claim 7 wherein the space separating said opposed texturing rolls is adjustable to accommodate webs of varying thicknesses.

9. The apparatus defined in claim 8 further comprising means for automatically adjusting said space between said opposed texturing rolls.

10. The apparatus defined in claim 1 further comprising means for manually turning said texturing rolls and said combining rolls to introduce a first end of the multiple plies of untextured web material from a continuous source into said rugation device and to manually advance the plies along said path of travel.

11. The rugation device defined in claim 1 wherein said drive means is an electric motor and wherein a belt and pulley system transmits rotary motion from said motor to said driven rolls.

12. The apparatus defined in claim 1 wherein said rotating disc blade has a serrated edge and wherein said blade rotates at about 4,000 rpm.

13. The apparatus defined in claim 1 wherein said mobile cart includes means for adjusting the height of said cantilevered core receiving arm whereby said arm may be positioned at an appropriate height for insertion into a roll core when the roll is stacked on a support means such as a pallet or the like, whereby said arm will support the roll and restrain the roll from substantial downward motion when a support means beneath the roll is removed, and further comprising means for lifting the rolls supported on said arms.

14. The apparatus defined in claim 13 wherein said cart has a plurality of said arms.

15. The apparatus defined in claim 14 wherein said cart has two said arms.

16. A rugation device for fabricating discrete segments of joined multiple ply cushioned web material for use as dunnage in packaging or the like, comprising:

a frame, drive means mounted on said frame;

a plurality of feed rollers on said frame device for collecting multiple plies of untextured web material from a continuous source and for directing the multiple plies in overlying, contacting relationship along a single predetermined path of travel;

a pair of driven interdigitized texturing rolls on said frame downstream of said feed rollers, one said texturing roll disposed on each side of said single path of travel for embossing a raised pattern on the overlying, contacting plies of web material and for advancing the web material along said path of travel, each said texturing roll having a plurality of discontinuous teeth projecting therefrom and intermediate bottom lands laterally separating said discontinuous projecting teeth, such that said teeth on each said texturing roll intermesh laterally with said teeth on said other texturing roll and overlie said intermediate lateral bottom lands on said other texturing roll;

a plurality of separating rollers on said frame located downstream from said texturing rolls for separating the overlying embossed plies of web material and individually directing each ply in divergent paths of travel;

driven combining rolls on said frame downstream of said separating rollers for recombining the separated plies of embossed web material into overlying, contacting relationship, said combining rolls being positioned such that each said divergent path of travel of each separated ply of embossed web material from said texturing rolls, over said separating rollers and to said combining rolls has a length different from the length of the path of travel of the ply adjacent thereto, whereby when the plies are recombined the embossed areas of each ply do not directly overlie each other but are offset, creating void areas between the adjacent plies to form a multiple ply cushioned web material;

means downstream from said combining rollers for severing the cushioned web material into discrete segments; and driven exit rollers for conveying the cut segments of cushioned web material from said rugation device.

17. The rugation device defined in claim 16 wherein said combining rolls have relatively narrow edge joining bands which prevent crushing of the embossed web material.

18. The rugation device defined in claim 16 wherein said means for severing the cushioned web material into discrete segments is a driven knife having opposed blades which converge on the embossed, overlying plies of web material from opposite sides of said path of travel.

19. The rugation device defined in claim 16 further comprising control means by which an operator may manually actuate said drive means and said severing means for intermittently advancing and embossing the web material and severing the material into discrete segments having desired lengths.

20. The rugation device defined in claim 19 wherein said control means is a foot switch.

21. The rugation device defined in claim 16 further comprising automatic means for actuating said drive means and said severing means for intermittently advancing and embossing the web material and for severing the embossed web material into discrete segments having preset lengths.

22. The rugation device defined in claim 16 wherein said severing means is a rotary knife which traverses the width of the web material.

23. The rugation device defined in claim 16 wherein said texturing rolls are identical.

24. The rugation device defined in claim 23 wherein said teeth project about 0.0910 inch from said rolls.

25. The rugation device defined in claim 24 wherein the space separating said opposed texturing rolls is adjustable to accommodate webs of varying thicknesses.

26. The rugation device defined in claim 25 further comprising automatic means for adjusting said space separating said opposed texturing rolls.

27. The rugation device defined in claim 16 further comprising means for manually turning said feed rollers, said texturing rolls and said combining rolls to introduce a first end of the multiple plies of untextured web material into said rugation device from a continuous source and for manually advancing the plies along said path of travel.

28. The rugation device defined in claim 16 wherein said drive means is an electric motor and wherein a belt and pulley system transmits rotary motion from said motor to said driven rolls.

* * * * *

UNITED STATES PATENT AND TRADEMARK OFFICE

CERTIFICATE OF CORRECTION

PATENT NO. : 5,203,761

DATED : April 20, 1993

INVENTOR(S) : Reichental, et al.

It is certified that error appears in the above-indentified patent and that said Letters Patent is hereby corrected as shown below:

Column 3, line 2, "out" should be --cut--

Column 3, line 29, after "the" insert --nip of the--

Column 4, line 29, delete "rollers" second occurrence

Column 7, line 52, "hal" should be --half--

Column 8, line 56, "Wheels" should be --wheels--

Column 9, line 57, "72" should be --70--

Column 10, line 2, after pylon delete "7" and insert --75--

Column 10, line 13, "so" should be --80--

Column 10, line 17, "so" should be --80--

Column 10, line 32, "so" should be --80--

Column 10, line 49, "so" should be --80--

UNITED STATES PATENT AND TRADEMARK OFFICE

CERTIFICATE OF CORRECTION

PATENT NO. : 5,203,761

DATED : April 20, 1993

INVENTOR(S) : Reichental, et al.

It is certified that error appears in the above-indentified patent and that said Letters Patent is hereby corrected as shown below:

In Column 13, line 47, after frame delete "," and insert --;--

Signed and Sealed this

Fourteenth Day of December, 1993

*Attest:*

Bruce Lehman

BRUCE LEHMAN

*Attesting Officer*

*Commissioner of Patents and Trademarks*